US006666566B1

(12) United States Patent
Uke

(10) Patent No.: US 6,666,566 B1
(45) Date of Patent: Dec. 23, 2003

(54) EMERGENCY DEVICE WITH GLASS BREAKING FUNCTION

(75) Inventor: Alan K. Uke, Del Mar, CA (US)

(73) Assignee: Underwater Kinetics, Poway, CA (US)

( * ) Notice: Subject to any disclaimer, the term of this patent is extended or adjusted under 35 U.S.C. 154(b) by 0 days.

(21) Appl. No.: 09/439,801

(22) Filed: Nov. 12, 1999

(51) Int. Cl.[7] ..... F21L 7/00

(52) U.S. Cl. ..... 362/202; 362/109; 362/119; 362/208; 362/390; 362/120

(58) Field of Search ..... 362/202, 253, 362/109, 119, 208, 390, 369, 120; 204/197; 429/247; 81/26

(56) References Cited

U.S. PATENT DOCUMENTS

| | | | | |
|---|---|---|---|---|
| 3,772,781 | A | | 11/1973 | Newman |
| 3,930,525 | A | | 1/1976 | Stoneburner |
| 4,545,440 | A | | 10/1985 | Treadway |
| 4,906,049 | A | | 3/1990 | Anderson |
| 5,097,599 | A | | 3/1992 | Hasegawa |
| 5,562,257 | A | | 10/1996 | Graveman et al. |
| 5,657,543 | A | | 8/1997 | Collins |
| 5,860,334 | A | | 1/1999 | Coonrad |
| 5,904,414 | A | * | 5/1999 | Monteleone et al. ..... 362/205 |
| 5,952,916 | A | | 9/1999 | Yamabe |
| 6,126,292 | A | * | 10/2000 | Liu ..... 362/102 |
| 6,139,165 | A | * | 10/2000 | Crowe ..... 362/102 |
| 6,199,997 | B1 | * | 3/2001 | Outsen et al. ..... 362/109 |
| 6,299,324 | B1 | * | 10/2001 | Kim ..... 362/119 |

FOREIGN PATENT DOCUMENTS

| | | |
|---|---|---|
| JP | 07319492 | 11/1995 |
| WO | WO 99/17050 A2 | 4/1999 |

* cited by examiner

*Primary Examiner*—Thomas M. Sember
*Assistant Examiner*—Anabel Ton
(74) *Attorney, Agent, or Firm*—Foley & Lardner

(57) ABSTRACT

An emergency device includes a housing having a lamp end and a rear distal end, with a gripping area therebetween. A mounting area is provided on the housing at the distal end, with the mounting area being generally perpendicular to a length direction of the housing. A glass breaking spike is mounted on the mounting area. In use, the flashlight is propelled towards a glass pane so that the glass breaking spike strikes the glass pane at an impact point. Since inertial energy of the flashlight and flashlight batteries is also concentrated in the glass breaking spike, inertial forces are transferred to the glass breaker and assist in propelling the glass breaker into the pane of glass.

34 Claims, 14 Drawing Sheets

EMERGENCY DEVICE WITH GLASS BREAKING FUNCTION

FIELD OF THE INVENTION

The field of the present invention is handheld emergency tools such as handheld flashlights for emergency use.

BACKGROUND OF THE INVENTION

Flashlights are commonly used in emergency situations. For example, firefighters or other emergency personnel use flashlights to provide illumination at an emergency site. Such illumination is not only needed at night, but also can be necessary during daylight hours for emergencies occurring in dark areas such as a dark or smoke-filled building. Since flashlights are often used, emergency personnel frequently routinely carry a flashlight or have one at hand.

Many flashlights are known. For example, commonly invented and assigned U.S. Pat. No. 5,904,415 discloses a flashlight with a gas permeable membrane and battery polarization carrier. This patent is incorporated herein by reference as if set forth in its entirety herein.

Emergency or rescue personnel (such as firefighters or police) often are required to break glass while responding to an emergency. For example, rescue personnel responding to an automobile accident may need to break a vehicle window or windshield to reach a trapped victim. Breaking vehicle glass can be difficult as vehicle windows typically are constructed of a tempered glass. Tempered glass is also often used in other instances that may present barriers in emergency situations, such as in sliding glass doors, entry door panes, and windows close to an exit. Thus, there are situations in which emergency personnel need to break tempered glass in areas that do not involve vehicles.

Tempered glass typically is constructed to deform into small glass fragments when broken. In contrast, non-tempered glass frequently will shatter into relatively sharp shards when broken, which may present hazards to victims and rescue workers in emergency situations. Thus, the use of tempered glass minimizes the risk of injury due to broken glass. Tempering also provides an increased level of impact resistance for glass.

In one example, the tempering process deposits or creates a thin layer over a glass pane (such as 0.0020–0.0030 inch), which tends to resist breakage. In order to break a pane of temper glass cleanly and safely, this thin layer typically needs to be penetrated.

Emergency personnel typically use a hammer or axe to break tempered glass. Of course, emergency personnel must use extreme caution when swinging a hammer or axe through a window so as to avoid injury to themselves, victims or property from glass fragments, or from the hammer or axe alone. For example, swinging an axe or hammer concentrates significant inertial forces in the tool's head. When the axe or hammer impacts a windowpane, the substantial inertia in the hammer or axe may propel the hammer or axe toward or into a victim or property and may strike on the other side. Because of the potential for injury due to hammers and axes, rescue personnel may feel constrained to use restraint when breaking glass to avoid injuries to people or property.

It is desirable that emergency personnel carry equipment to handle diverse situations. In order to diminish the load such people must carry, it is desirable to provide a single device to perform multiple tasks, thereby reducing the number of devices that must be carried.

Various multi-function emergency tools have been provided. For example, U.S. Pat. No. 5,657,543 discloses an emergency tool having a seatbelt cutting knife and a spring-loaded spike in a single tool. This tool is specifically designed for use during a car rescue. Rescue personnel can use the knife to cut a victim free from a seat belt. The tool also is designed to provide a glass breaking function. This device suffers a disadvantage in that in order to break glass, the user must compress and cock a glass-breaking spike. The device is placed against a glass pane and the user releases a trigger. Thereby the glass-breaking spike is propelled into the glass driven by a spring force. This tool is especially complicated to use for breaking multiple panes of glass in succession, as may be required if multiple car or house windows must be broken. An additional disadvantage is that the extra time required to load, cock, and trigger the device might hinder a rescue operation.

A multiple-use emergency escape tool is described in U.S. Pat. No. 5,097,599. This tool combines a scissors with a retractable spike driver. The spike is initially loaded into a retraction member and held there under spring tension. In use, an exposed end of the spike is pressed against a window glass. Then, the driver is propelled by the spring force toward the spike. The force of the driver is transferred to the spike, causing an impulse onto the window glass. This device suffers a disadvantage in that the spike driver must be reset for each use of the tool. In an emergency situation, a user can be occupied with resetting the driver for each window to be broken, a task requiring time and some skill.

Another multiple-use tool is illustrated in U.S. Pat. No. 5,952,916. This tool has a light bulb housed in a main body for emitting warning light or for providing illumination as a flashlight. A percussion imparting member is mounted on the head of the signaling device adjacent the light bulb, which can be used for breaking glass. The percussion imparting member extends radially from the housing of the signaling device at a point near the light bulb. Thus, the head of the signaling device acts as a hammer for breaking a window glass. A disadvantage is that the percussion member extends from the head of the signaling device, so a user needs to use some skill to make sure the percussion imparting member squarely strikes the window glass while not injuring the light bulb or transparent lens window. By using the device as a glass hammer, the user risks damaging or ruining the light bulb, the filament in the light bulb, or breaking its lens. A further disadvantage of this device is that the head is an area of low mass concentration, because batteries tend to have a higher mass, and in this device are located away from the glass hammer.

Accordingly, there exists a need for an emergency tool having multiple capabilities that can break glass in an efficient manner.

SUMMARY OF THE INVENTION

The present invention alleviates to a great extent the disadvantages of the known glass breaking devices by providing a multi-function emergency tool that efficiently breaks glass, while also providing illumination. In the preferred embodiment, a flashlight is provided which includes a housing having a lamp end and a rear distal end, and, typically, a gripping area therebetween. Batteries are preferably housed to the rear of the lamp end. A mounting area supporting a glass breaking member is provided on the housing at the rear end.

In a one embodiment, the mounting area is generally perpendicular to a length direction of the housing. In use for breaking glass, the flashlight is propelled rear-end first (i.e. in a length or axial direction) towards a target (i.e., a glass pane) so that the glass breaking element strikes the glass pane at an impact point. Furthermore, using this device, inertial energy of the flashlight and flashlight batteries is concentrated in the axial direction, assisting in propelling the glass breaker into the pane of glass. One of the advantages of the present invention is that the breaking force imparted in the length direction of the flashlight can be positively and relatively easily controlled by the user. In such a manner, the user is able to break a pane of glass in a relatively safe and controlled manner.

In another embodiment, the mounting area is transverse to the length direction. A glass breaking element is mounted, with a striking surface extending out one or both sides of the flashlight. In use for breaking glass, the flashlight is propelled rear-end first in a hammer-type motion towards a target (i.e., a glass pane) so that the glass breaking element strikes the glass pane at an impact point. Furthermore, using this device, inertial energy of the flashlight and flashlight batteries is concentrated in the direction of motion, assisting in propelling the glass breaker into the pane of glass.

An advantage of the present invention is that the inertial mass of the emergency device (i.e. flashlight) is concentrated at the striking surface. One way this is achieved is by placing the batteries in close proximity to the rear (i.e. distal) end of the flashlight, rather than displaced forward as in known spring loaded flashlights. In such a manner, the user is able to break a pane of glass in a relatively efficient and controlled manner. Moreover, the number of devices to be carried by emergency personnel can be reduced because an efficient glass breaking capability is provided on a flashlight, rendering a hammer or axe unnecessary in many applications. In addition, because the striking surface is at the far end of the device from the illumination source (light bulb), the potential for damage to the illumination source (including the bulb filament) is reduced.

These and other features and advantages of the present invention will be appreciated from review of the following detailed description of the invention, along with the accompanying figures in which like reference numerals refer to like parts throughout.

DETAILED DESCRIPTION OF THE INVENTION

Figure 1:
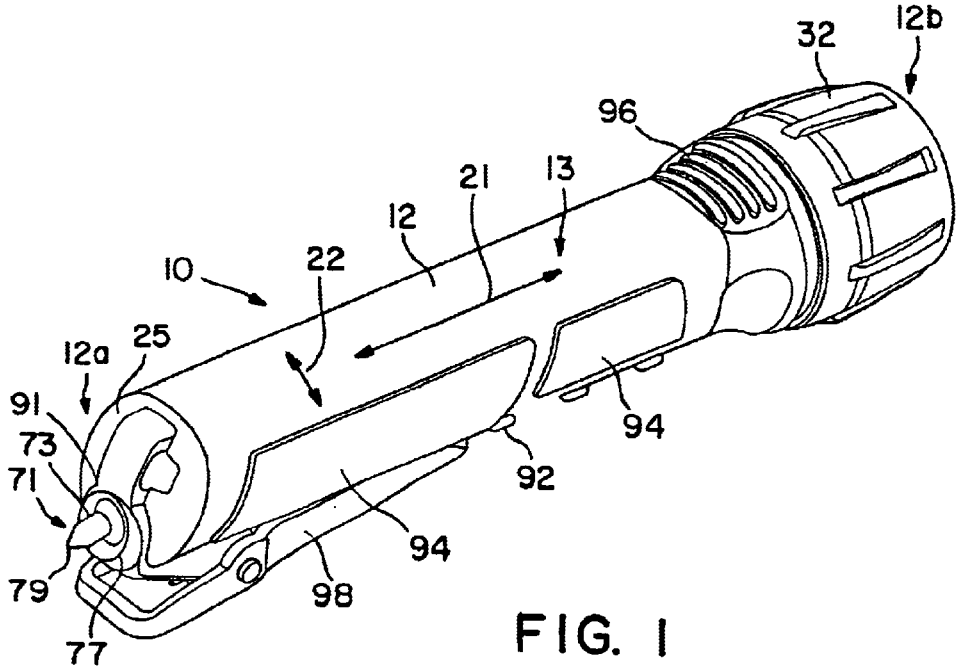
FIG. 1 is a perspective view of an emergency flashlight made in accordance with the present invention.
Figure 2:
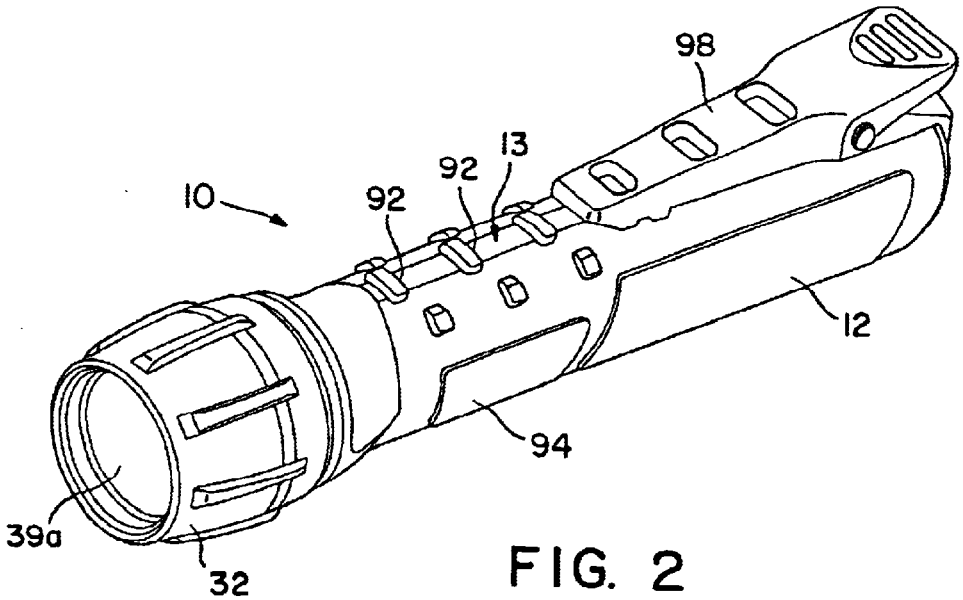
FIG. 2 is another perspective view of the emergency flashlight made in accordance with the present invention.

Referring now to FIGS. 1, 2, 14 and 15, an emergency tool 10 made in accordance with a preferred embodiment of the present invention is provided. It is preferred that the emergency tool 10 be a flashlight and for the remainder of this description the emergency tool will interchangeably be referred to as "flashlight 10" or "emergency flashlight 10", although it should be appreciated that emergency tools other than flashlights may be equipped with the glass breaking and inertia concentrating apparatus of the present invention.

The emergency flashlight 10 generally comprises a housing 12 having a rearward (or distal) end 12*a* and a forward end 12*b* (also referred to as the lamp end). Optionally, housing 12 has various grip elements such as projections 92, facets 94 and ribs 96, which can help a user to grasp the housing in a grip area 13. Any gripping configuration can be used in addition to those illustrated, although the gripping area 13 preferably is provided on the housing 12 between the lamp end 12*b* and the rearward end 12*a*. The preferred embodiment of the emergency flashlight 10 provides the housing 12 in a generally cylindrical shape, although any other shape may be used. The housing 12 has an axis running in a length direction 21, i.e., the axial direction. It also has an axis running in a transverse, or radial, direction 22, which is perpendicular to the length direction 21. An optional hinged clip 98 (illustrated for example in FIGS. 1 and 2) may be provided to facilitate attaching the emergency flashlight 10 to a user's belt or other clothing. As illustrated, the clip 98 includes a hinge receiving aperture 255 for mounting to the housing 12, although any structure for securing to the housing may be used. In the illustrated embodiment, the aperture 255 receives post 260, which in turn is mounted within apertures 265 in the housing 12. Optional coil spring 270 is provided to bias the clip towards the housing 12.

Alternatively, an optional cutting tool 150 (illustrated for example in FIGS. 15 and 25) may be provided, such as might be used to cut a seat belt trapping a victim. In the illustrated embodiment, the cutting tool 150 includes a cutting blade 155 that is shielded within guide surfaces 152, 153. Preferably, the cutting blade 155 is retained in the housing of the flashlight such as by using spring clips engaging holes 156 on the cutting blade. In addition, the cutting blade 155 preferably has two cutting surfaces 157, 158, allowing the cutting blade 155 to be reversed when one of the cutting surfaces becomes dull. In use, the user may grasp the flashlight in any fashion and engage a material (such as a seatbelt or other web) to be cut by guiding the cutting knife 150 using the guide surfaces 152, 153 to engage the material with the cutting blade 155. Once the material is engaged, the flashlight may be pulled, thereby providing force for the cutting blade 155 to cut the material to be cut. For example, the user may pull from the front end 12*a* such as with the gripping assistant of grip surface 96. It is noted that in a preferred embodiment, the cutting knife has a rounded top surface 159. By providing such a surface without sharp edges, it is easier to insert the flashlight 10 in a pocket, without catching it on the pocket material.

Preferably both the cutting tool 150 and the clip 98 are removable, allowing a user to select the desired configuration of the flashlight 10.

Figure 25:
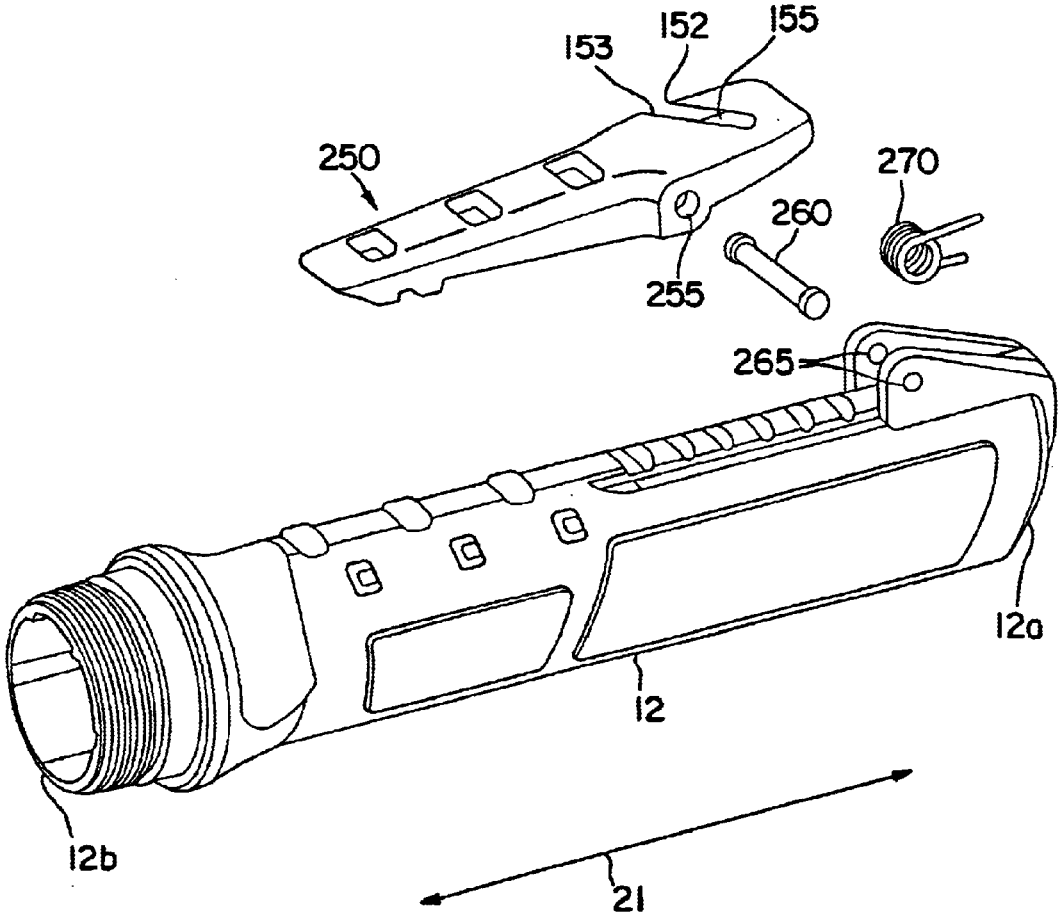

In an alternative embodiment illustrated in FIG. 25, a combined cutting tool and clip is provided. This combined cutter/clip is illustrated with reference number 250. As illustrated, the combined cutter/clip 250 includes a hinge receiving aperture 255 for mounting to the housing 12, although any structure for securing to the housing may be used. In the illustrated embodiment, the aperture 255 receives post 260, which in turn is mounted within apertures 265 in the housing 12. Optional coil spring 270 is provided to bias the clip towards the housing 12. The combined cutter/clip 250 includes guide surfaces 152, 153 and cutting blade 155.

Referring now to FIGS. 6–9 and 17–20, the rearward end 12*a* of the housing 12 is closed with a rear wall 25. The rear wall 25 includes a mounting area 91 (or 191) receiving glass breaker 71. The glass breaker 71 preferably includes at least one tip 79 for impacting and breaking glass.

In use, a user of the emergency flashlight 10 may hold the emergency flashlight 10 in any fashion, although the gripping area 13 is provided as a convenience. In such a manner, the user can conveniently position the lamp end 12*b* of the emergency flashlight 10 to illuminate in a forward direction. When the user desires to break a pane of glass, the user may continue to hold the flashlight (in any fashion), and propel the glass breaker 71 toward the window glass. When striking in this fashion, the inertial energy of the flashlight is concentrated at the distal end 12*a* by virtue of the concentration of mass at that end. The inertial energy transfers to the glass breaker 71, including its impact tip 79, when the glass breaker 71 hits the window pane. Because the user is securely grasping the housing 12, the glass breaking motion can be accomplished in a safe, controlled manner. Further, the clip 98 and/or the cutting tool 150 and/or the combined clip/cutter 250 also can assist in keeping the user's hand away from the striking surface should the user's hand slip during a striking motion. In such a manner, the clip 98 or cutting tool 150 or combined clip/cutter will act as a stop tending to inhibit the user's hand from slipping toward the rear end of the housing 12. It will be appreciated that any form of stop structure may also be provided that can serve to inhibit grip slippage in use.

In the embodiment illustrated in FIGS. 1, 2 and 6–9, the user can push the flashlight 10 in an axial direction, as indicated with arrow 21. In the embodiment illustrated in FIGS. 14, 15 and 17–20, the user can swing the rear portion of the flashlight 10 in a transverse direction so that the transversely mounted glass breaker 71 strikes a surface. This can be done with the user gripping the grip area 13 or alternatively the forward end 12*b*, such as near or at grip surfaces 96.

Figure 3:
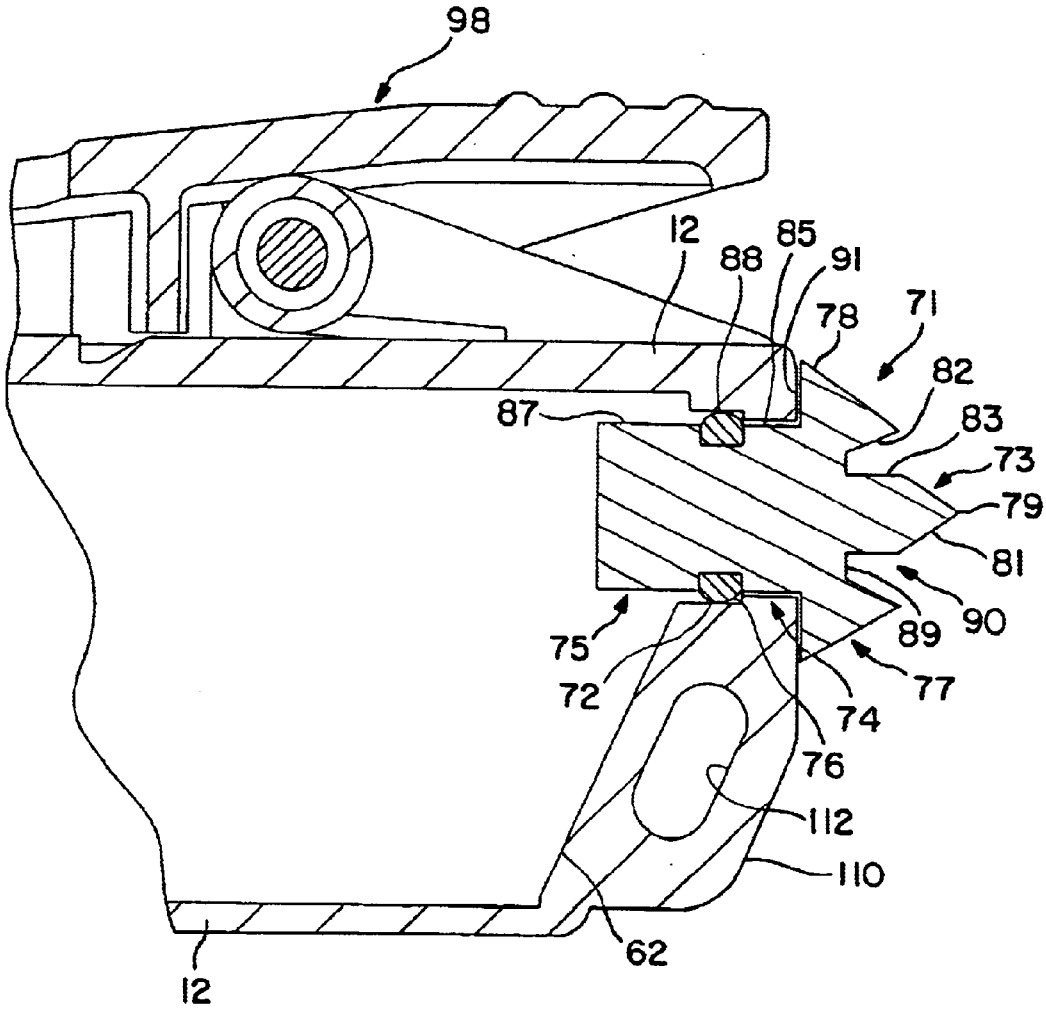
FIG. 3 is an enlarged cross-sectional side view of the distal end of an emergency flashlight made in accordance with the present invention.
Figure 4:
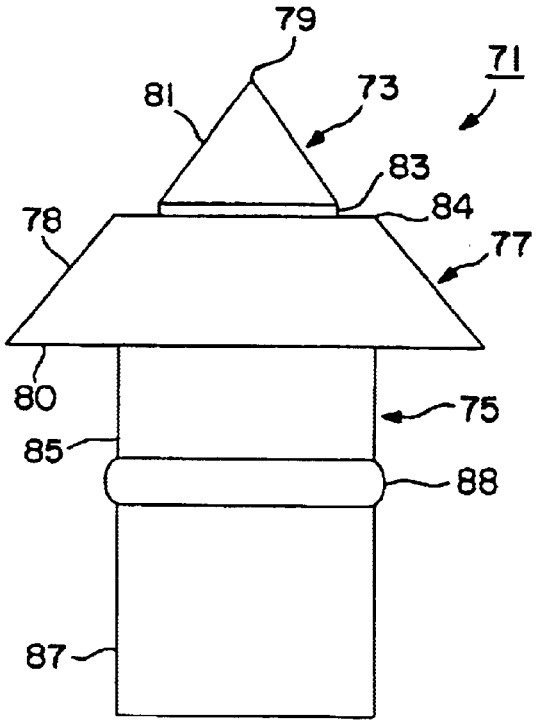
FIG. 4 is an enlarged side view of a glass breaker for use in an emergency flashlight made in accordance with the present invention.
Figure 5:
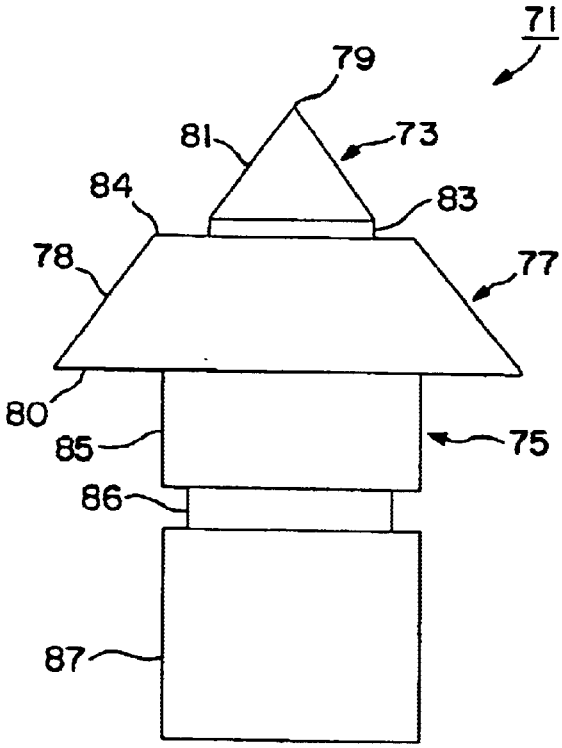
FIG. 5 is an enlarged side view of a glass breaker for use in an emergency flashlight made in accordance with the present invention.
Figure 6:
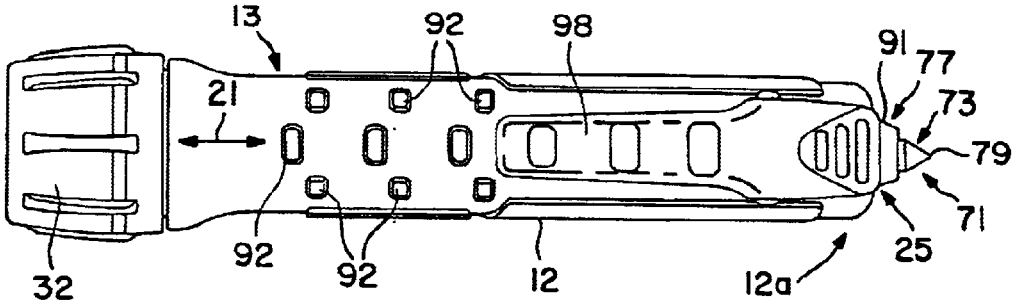
FIG. 6 is top view of an emergency flashlight made in accordance with the present invention.
Figure 7:
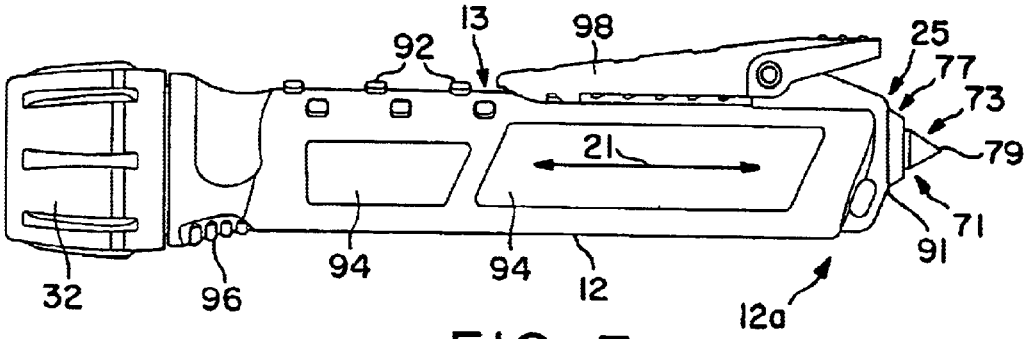
FIG. 7 is a side view of an emergency flashlight made in accordance with the present invention.
Figure 8:
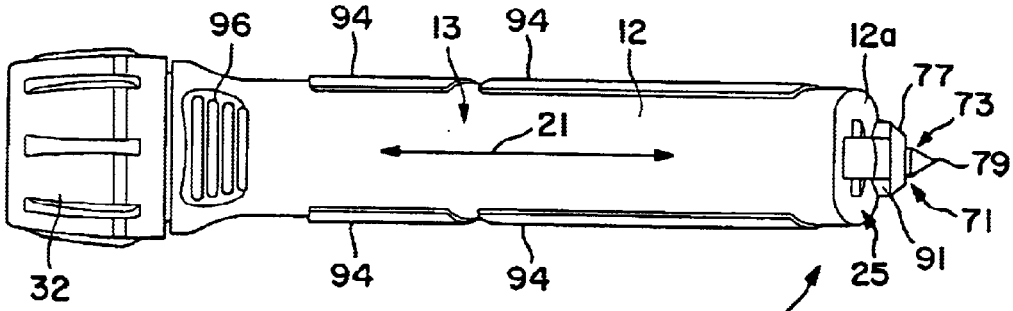
FIG. 8 is a bottom view of an emergency flashlight made in accordance with the present invention.
Figure 9:
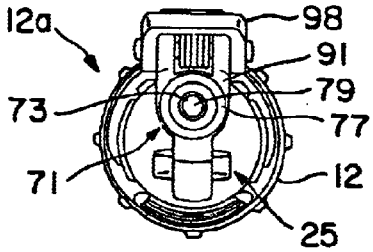
FIG. 9 is a view of the distal end of an emergency flashlight made in accordance with the present invention.
Figure 16:
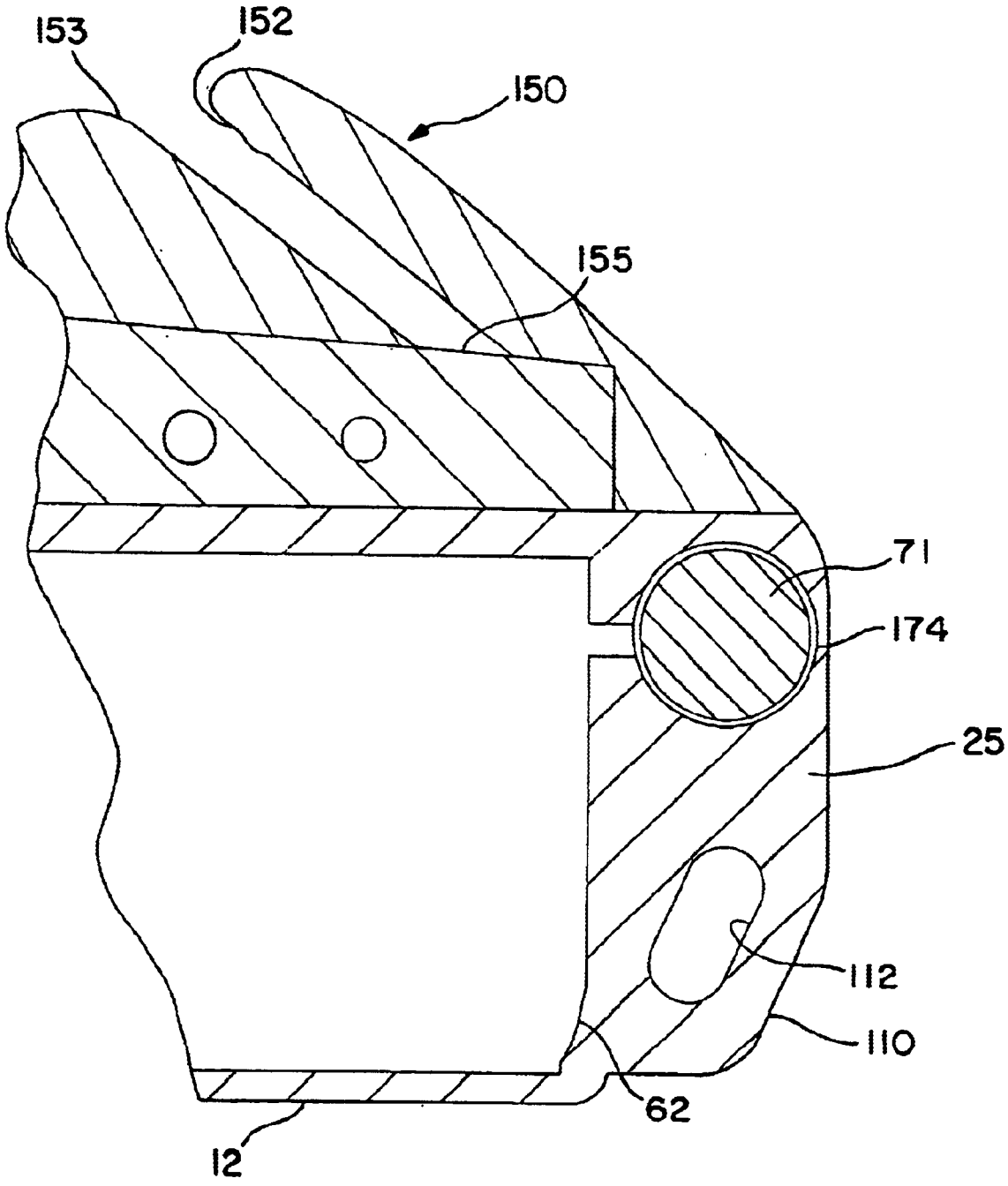
FIG. 16 is an enlarged cross-sectional side view of the distal end of an emergency flashlight made in accordance with the present invention.
Figure 17:
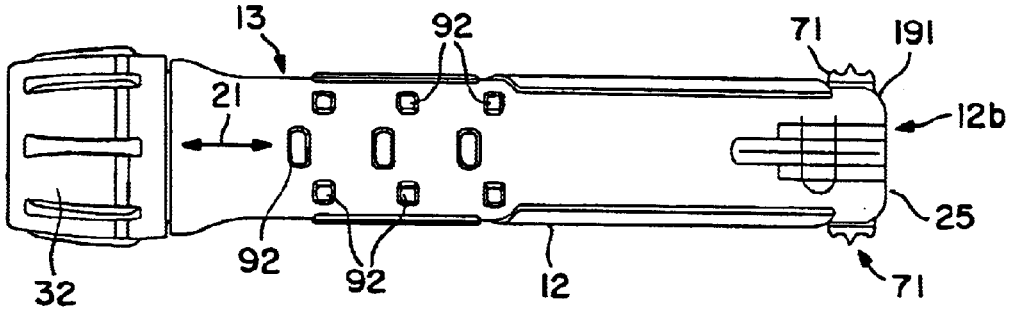
FIG. 17 is top view of an emergency flashlight made in accordance with the present invention.
Figure 18:
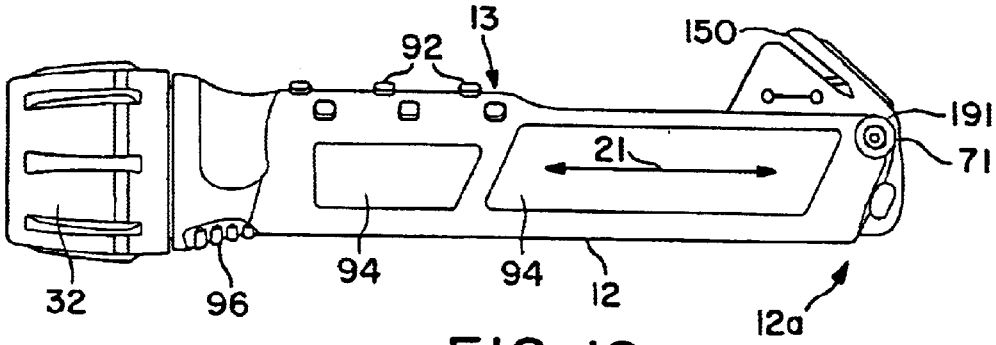
FIG. 18 is a side view of an emergency flashlight made in accordance with the present invention.
Figure 19:
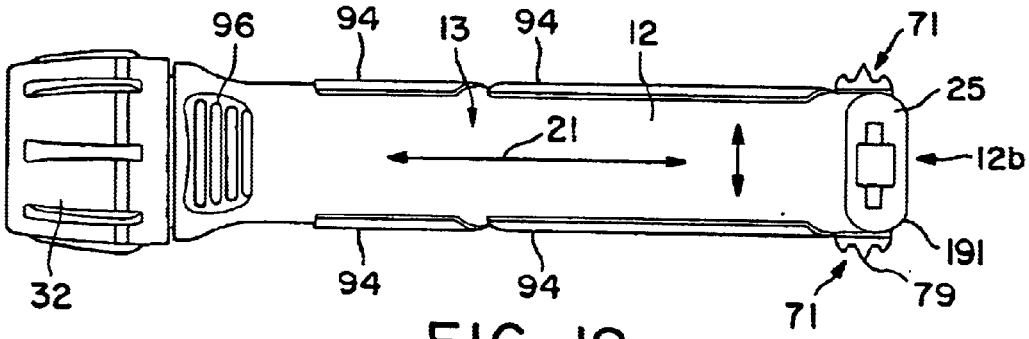
FIG. 19 is a bottom view of an emergency flashlight made in accordance with the present invention.
Figure 20:
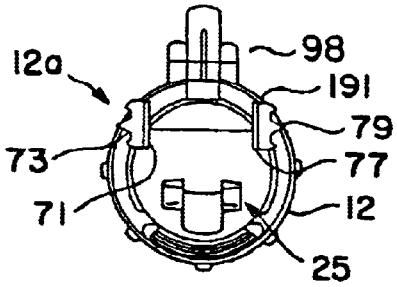
FIG. 20 is a view of the distal end of an emergency flashlight made in accordance with the present invention.
Figure 21:
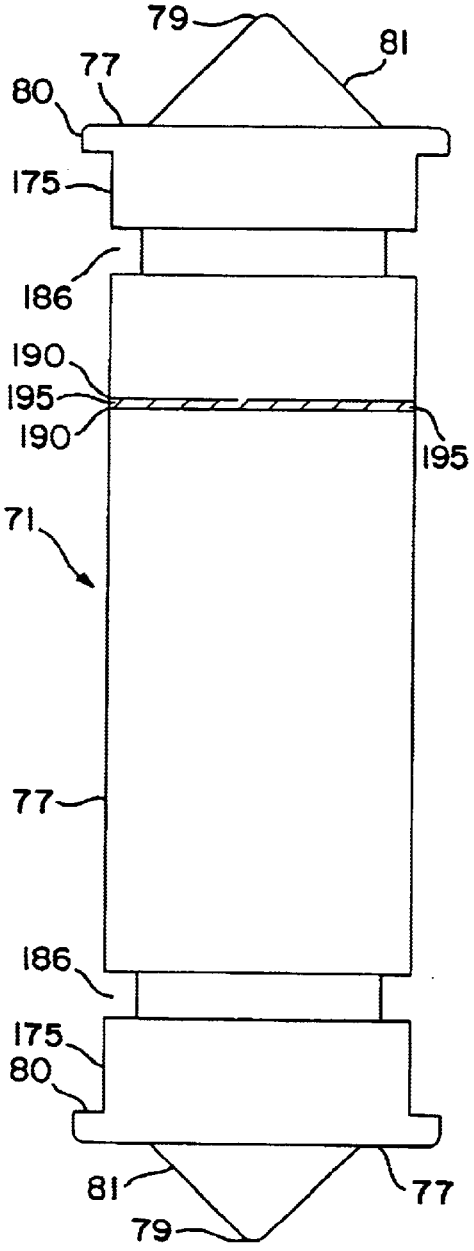
FIG. 21 is a side view of glass breakers for use in an emergency flashlight made in accordance with the present invention.
Figure 22:
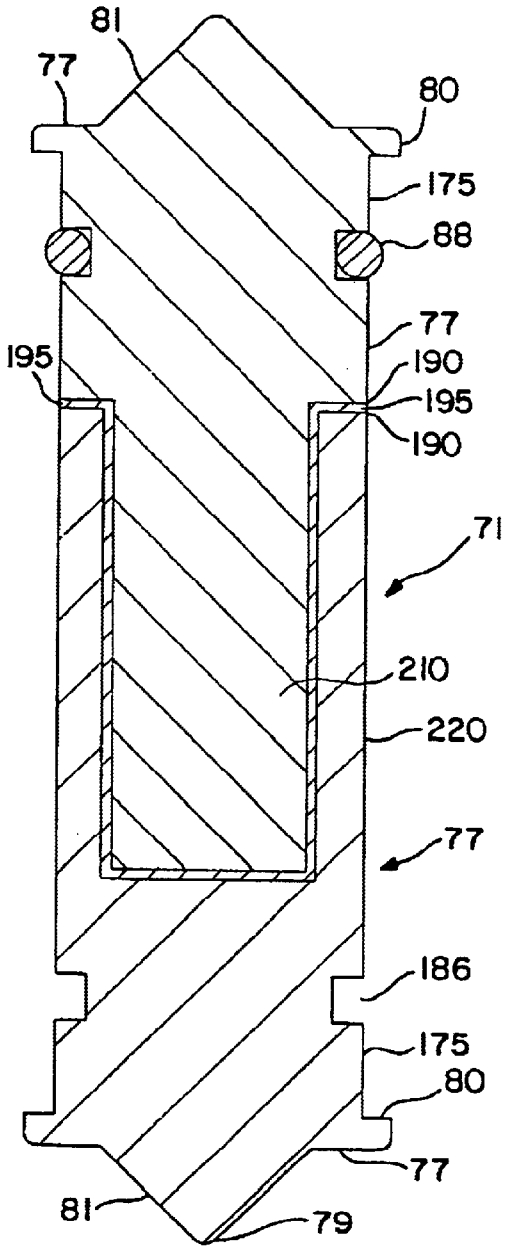
FIG. 22 is an side cross-sectional view of glass breakers for use in an emergency flashlight made in accordance with the present invention.
Figure 23:
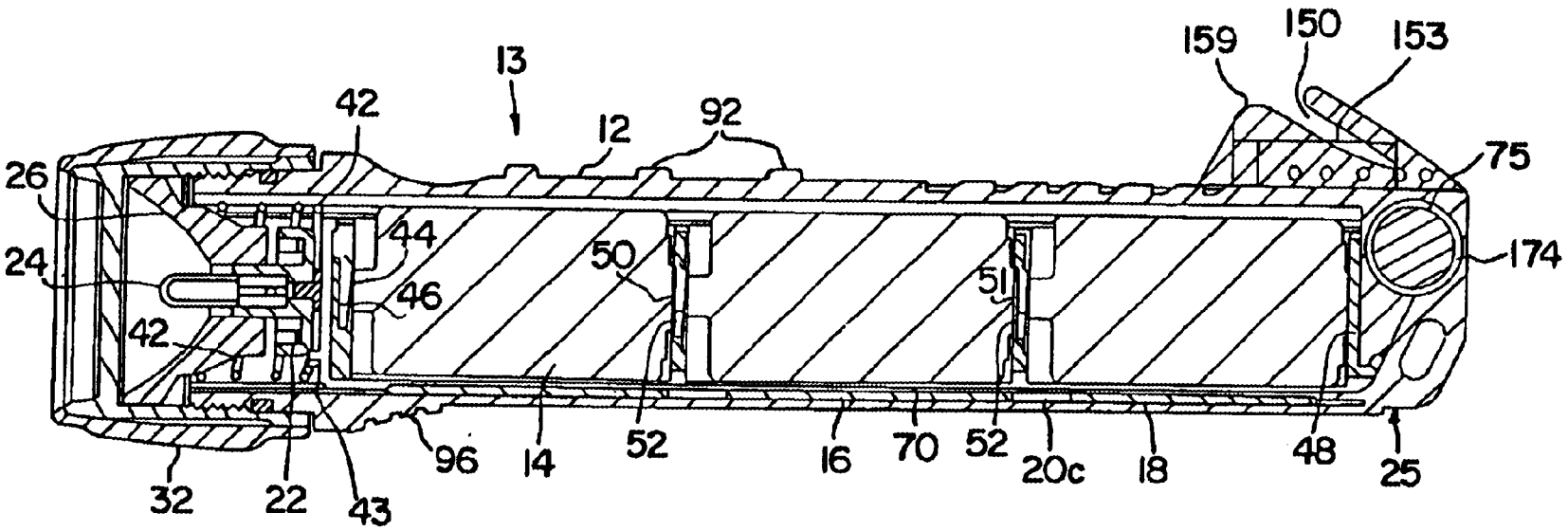
FIG. 23 is a cross-sectional side view of an emergency flashlight made in accordance with the present invention.
Figure 24:
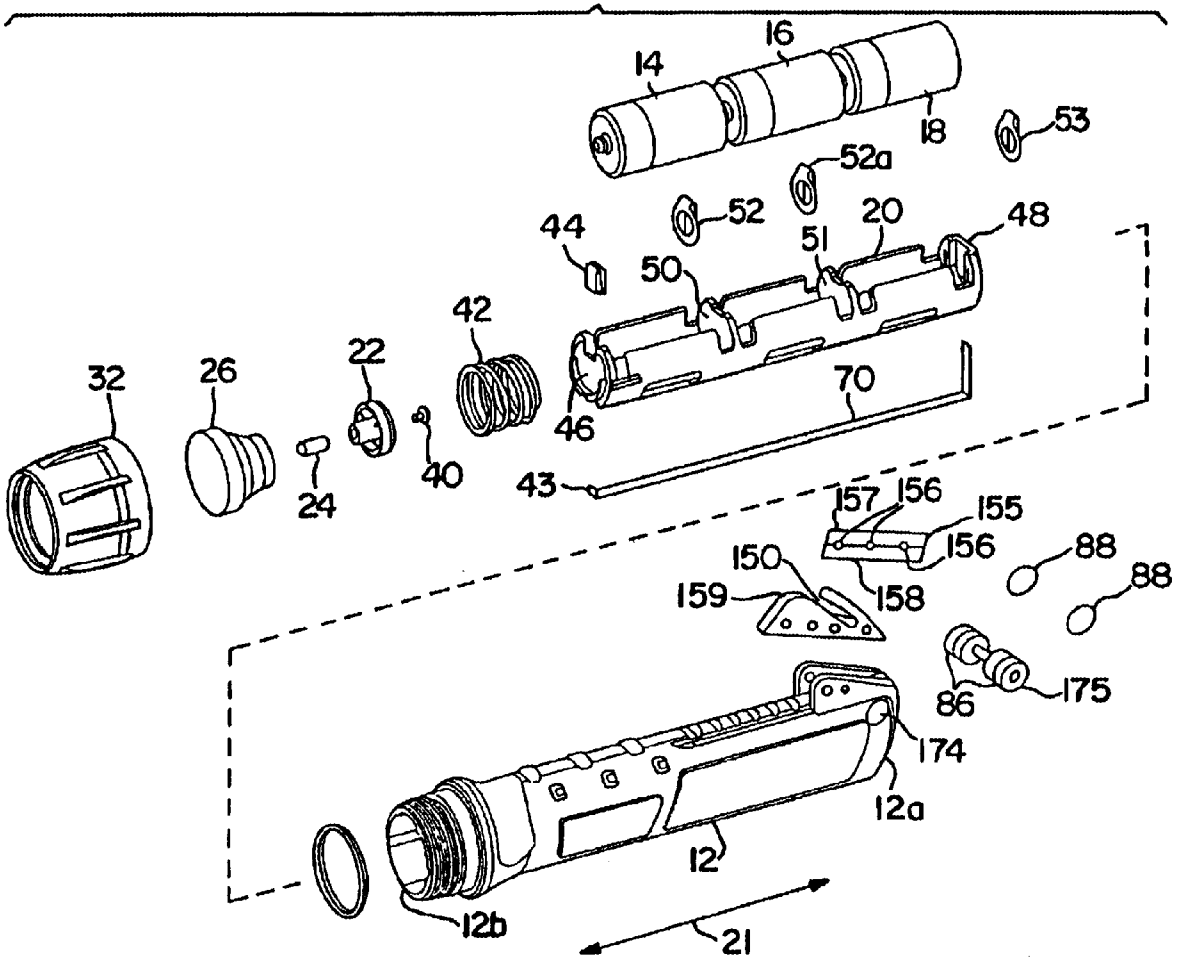
FIG. 24 is an exploded view of an emergency flashlight made in accordance with the present invention.

Referring now to FIGS. 3, 4, and 5 and 16, 21 and 22, the glass breaker 71 will be described in more detail. The glass breaker 71 generally comprises at least one spike 73 preferably mounted with some form of a base structure 77. A single spike system may be used as illustrated in FIGS. 3–5 or alternatively a dual spike system may be used as illustrated in FIGS. 16, 21 and 22. The dual spike system is preferred, although it should be understood that the invention can be practiced using the single spike system as well. In one embodiment the spike 73 has a shaft portion 83 mounted to or integrally formed with a floor 89 of the base 77. The shaft 83 can be any shape providing sufficient strength, although it is illustrated as being cylindrical. The shaft 83 extends from the floor 89. The shaft 83 has a cone portion 81 that comes to a peak at tip 79. It should be appreciated that any shape can be used and that a cone 81 and pointed tip 79 are for illustration purposes only. Other shapes that can serve to concentrate forces for impact may be used as well.

In the illustrated (and preferred) embodiment, the base 77 concentrically surrounds the shaft 83. The base 77 has an extended annular shoulder 80 that rests on the mounting area 91 of the housing 12. In such a manner, the shoulder 80 provides additional contact area and support for the glass breaker 71. In the preferred embodiment, the base 77 has an inclined wall 78 extending between the shoulder 80 and an upper rim 84. An inner wall 82 slopes from the rim 84 to the floor 89. In such a manner, an annular recess 90 is defined between the inner wall 82 and the shaft 83.

In the preferred embodiment the shaft 83 extends a short distance above the recess 90. In such a manner, only a short segment of the shaft 83, the conical portion 81, and the tip 79 of the spike 73 extend beyond the base 77. In such a manner, the base 77 acts to limit penetration of the spike 73 at the point of impact. Further, the rim 84 and the inclining side wall 78 act to assist in shattering a glass pane after the tip 79 and conical portion 81 have initially penetrated the glass.

As discussed above, it should be appreciated that other shapes may be substituted for the shaft 73, conical portion 81, and/or tip 79 while meeting the objectives of the invention. Dual tips 79 also may be provided. Further, it should be appreciated that any suitable size and shape of the base 77 can be used.

In the axially mounted embodiment a hole 74 is provided in the mounting area 91. The hole an internal 74 has an internal countersink 72 for providing a shoulder 76. A plug 75 is mounted with or integrally formed with the base 77. The plug 75 has a first portion 85 and a second portion 87 with an annular groove 86 therebetween. The annular groove 86 receives a rubber o-ring 88. The diameter of the hole 74 is set slightly larger than the diameter of the first portion 85. In such a manner, the plug 75 is received into the hole 74 and pressed until the shoulder 80 bottoms with the mounting area 91. The first portion 85 is sized such that the o-ring 88 is compressed as it is pressed through the hole 74, until it is positioned in the countersink 72 and rests adjacent the shoulder 76. In such a manner, the plug 75 is securely, but removably, retained in the hole 74.

However, with sufficient force applied to the plug 75, the o-ring 88 can be compressed and pass the shoulder 76. For example, if a compressive force is built within the housing 12, once sufficient pressure is built the internal compressive forces will cause ejection of the plug 75 from the housing 12. Thereby the plug 75 and the glass breaker 71 act as a safety pressure release to release dangerous pressures, which could build inside the housing if, for example, a battery has a chemical malfunction.

In operation of the axially mounted embodiment, the glass breaker 71 provides for a controlled and safe breaking of glass and can serve as a pressure release for unsafe pressure accumulation within the housing 12 of the emergency flashlight 10.

In operation, the glass breaker 71 provides for a controlled and safe breaking of glass and can serve as a pressure release for unsafe pressure accumulation within the housing 12 of the emergency flashlight 10.

In the dual spike transversely mounted embodiment illustrated in FIGS. 14–24, a hole 174 is provided in the mounting area 191. The hole 174 preferably has an internal countersink (not shown) for providing a shoulder (not shown). A post 175 extends inwardly from the cone 81. The post 175 includes mounting element 186, which is illustrated as an annular groove. When mounted within the mounting portion 191, the annular groove 186 receives a rubber o-ring 88 so as to hold it in place. The diameter of the hole 174 is set slightly larger than the diameter of the post 175. In such a manner, the post 175 is received into the hole 174 and pressed until the shoulder it is in place within the hole 174, such as where the rubber o-ring 88 is received within the internal countersink hole 174.

In the transversely mounted embodiment, the hole 174 preferably extends through the entire width of the rear end 12*a* of the flashlight 10. Two glass breakers 71 are inserted into the hole 174, with their respective tips 79, 79 extending from the two ends of the hole 174. In this way, a dual spike system is created, with transverse mounting. The spikes may be individually mounted using the rubber o-rings 88 as described above. Alternatively (or additionally), they may be fixed within the hole with additional mechanical support, such as using an adhesive. Any form of adhesive may be used that will retain a glass breaker 71 within the hole 174 with sufficient adhesive force to retain the glass breaker 71 in place when used to strike a target object.

It should be appreciated that a glass breaker 71, with two tips 79 at opposite ends may be used. Alternatively, glass breakers can be used and mounted so that their respective tips 79, 79 extend opposite one another out of opposite sides of hole 174. In this embodiment, the glass breakers 71 optionally may be mounted or bound to one another. For example, as illustrated in FIG. 21, the rear sides 190, 190 of two adjacent spikes are lined up adjacent one another. An adhesive layer 195 is provided between the rear sides 190, 190 adhering them together. Alternatively, as illustrated in FIG. 22, a mechanical bond can be provided, with the rear end 190 of one glass breaker 71 having a protruding member 210 and the rear end 190 of the other glass breaker 71 having a receiving surface 220 defining a receiving aperture. Optionally, the protruding member 210 and inside surface of receiving surface 220 may be threaded, affording further mechanical stability. It should be appreciated that any shape post 210 and receiving surface 220 may be provided so long as they sufficiently match one another to allow for mounting the two spikes together. In one embodiment, further mounting force is provided by furnishing an adhesive between the two glass breakers 71, allowing them to be further adhered together via an adhesive layer 195.

Figure 10:
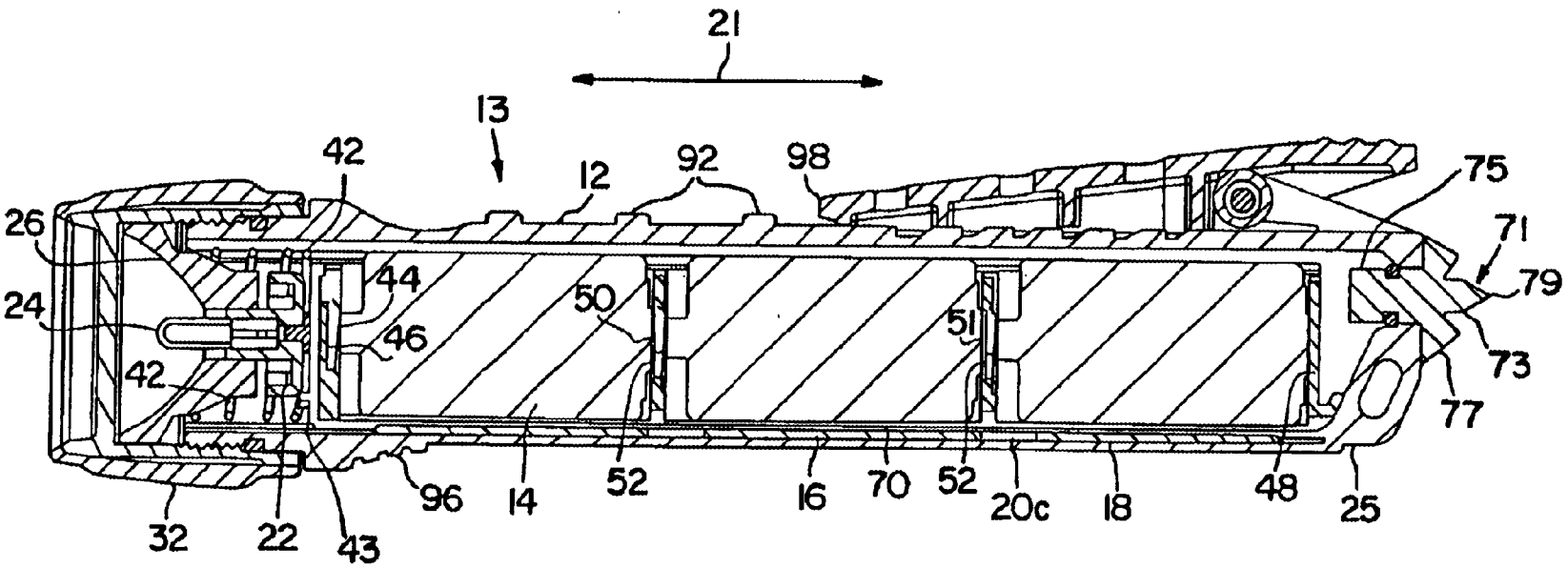
FIG. 10 is a cross-sectional side view of an emergency flashlight made in accordance with the present invention.
Figure 11:
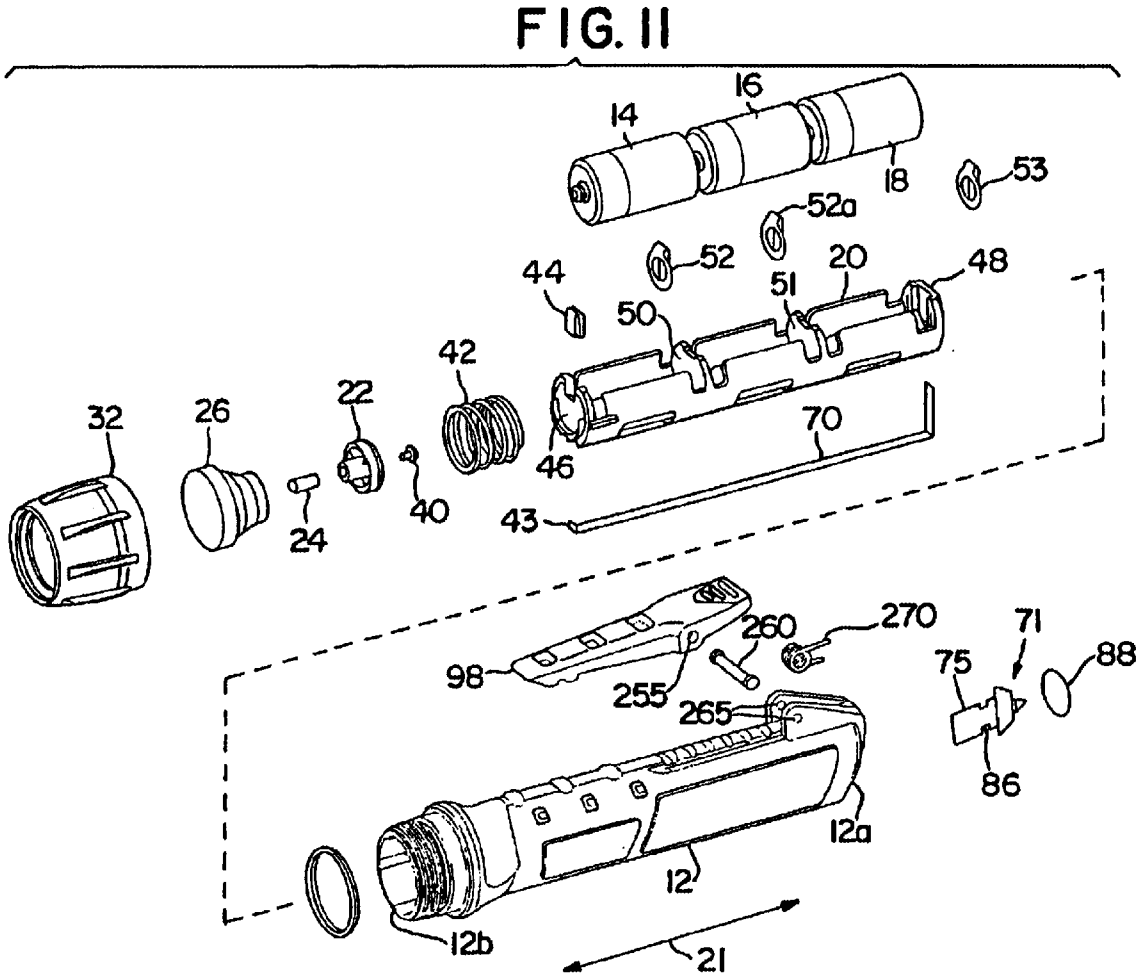
FIG. 11 is an exploded view of an emergency flashlight made in accordance with the present invention.

Referring now to FIGS. 10 and 11, batteries 14, 16 and 18 are positioned in the housing 12. The batteries 14, 16 and 18 are generally positioned adjacent the gripping area 13, although they can be positioned anywhere within the apparatus. In addition, any number of batteries may be used as desired. The batteries 14, 16 and 18 in the illustrated embodiment represent a significant portion of the mass of the emergency flashlight 10. Since the batteries are located adjacent the gripping area, the emergency flashlight 10 provides a user superior control of inertia generated while moving the flashlight. Therefore, a user is able to control the flashlight safely and accurately while propelling the glass breaker 71 toward a pane of glass.

Further, since the glass breaker 71 is mounted at the rear end 12*a*, the inertial force assists in driving the glass breaker into the glass at the point of impact. Indeed, the batteries 14, 16 and 18 are serially aligned with the length direction 21, thereby further concentrating inertia forces in the glass breaker 71 in the axially mounted glass breaker embodiment.

However, these same inertial forces generated in the length direction 21 could potentially damage one or more of the batteries 14, 16 and 18. Indeed, such inertial forces could collapse the posts on one or more of the batteries 14, 16 and 18, thereby causing the emergency flashlight 10 to malfunction as the flow of electrical energy could be disrupted. Typically, in known batteries the post portion tends to be a weaker portion of the battery structure. Damage to a battery may also lead to undesired chemical reactions causing caustic or other detrimental effects. Therefore, the preferred embodiment of the emergency flashlight 10 positions the batteries 14, 16 and 18 in a protective battery carrier 20.

The protective battery carrier 20 has a front wall 46, a rear wall 48, and dividers 50 and 51. In such a manner, the protective carrier 20 holds battery 14 in a compartment bounded by the front wall 46 and divider 50, a second battery in another compartment bounded by the divider 50 and the divider 51, and the third battery 18 in yet another compartment bounded by the divider 51 and rear wall 48. The battery carrier, along with the front wall, intermediate walls 50 and 51, and rear wall 48 are constructed from a rigid plastic material for providing superior impact resistance. Electrical conductivity is provided between compartments by conductive contacts 52 and 52*a*. Conductivity at the rear end of the battery carrier 20 is provided by conductive contact 53, while conductivity at the front end of the battery carrier 20 is provided by contact member 44. Conductive member 43 provides electrical connection from the conductive contact 53 to the spring 42 at the front end of the housing 12.

The lamp 24 is inserted into a socket assembly 22. A metal rivet 40 is inserted into the socket assembly 22 for providing electrical contact to one terminal of the lamp 24. The other terminal of the lamp is electrically connected to the reflector 26, which is electrically connected to the spring 42. When the threaded barrel 32 is threaded onto the housing 12, the lamp and socket assembly 22 is drawn toward the battery carrier 20. As the threaded barrel 32 is further threaded to the housing 12, the spring 42 is compressed until the rivet 40 makes contact with the contact member 44. Thereby as the threaded barrel 32 is threaded on to the housing 12, an electrical circuit is created between the batteries 14, 16 and 18 and the lamp 24. Thereby the lamp 24 is illuminated and in association with reflector 26 provides illuminating light through the lamp end of the emergency flashlight 10.

As shown in FIG. 10, to further reduce the risk of damaging batteries 14, 16 and 18 during an impact motion, the battery carrier 20 is securely held against the rear wall 25 of the housing 12 by the spring tension from spring 42. By having the protective battery carrier 20 bottomed against the rear wall 25 of the housing 12, internal battery and battery compartment movement is minimized at the time of impact. In such a manner, the risk of damaging internal components of the flashlight and the batteries is minimized.

Although the preferred embodiment shows the use of three C batteries serially aligned, those skilled in the art will recognize other numbers and configurations of batteries may be used while retaining the spirit of this invention.

Figure 12:
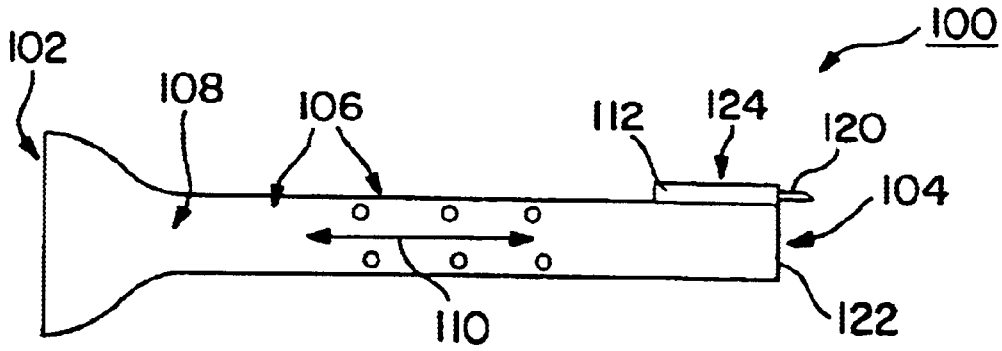
FIG. 12 is an illustration of another emergency flashlight made in accordance with the present invention.

An alternative embodiment of an emergency flashlight in accordance with the present invention is illustrated in FIG. 12. Emergency flashlight 100 has a lamp end 102 and a distal end 104. A gripping area 106 is provided between the lamp end 102 and the distal end 104. The emergency flashlight 100 generally comprises a housing 108 in a cylindrical shape. Batteries (not shown) are aligned within the housing 108 in a length direction 110. A spike mount 112 is provided on the circumference of the housing 108 adjacent to the distal end 104. The spike mount 112 has a retractable spike 120 that can be extended in the length direction to extend beyond a back wall 122 of the housing 108. A locking lever 124 locks the spike 120 either in an extended position as shown, or in a retracted position (not shown). When extended, the spike 120 extends generally perpendicularly from the back wall 122 in the length direction 110.

As with the embodiment discussed previously, pertaining to emergency flashlight 10, the embodiment of emergency flashlight 100 can be used to break glass with a stabbing or jabbing motion that propels the spike 120 into a pane of glass. Similar to emergency flashlight 10, inertial forces of the batteries are directed along the length direction 110 and assist in propelling the spike 120 into the glass pane. Further, the rear wall 122 of the housing 108 acts to limit the depth that the spike can penetrate and further assists in shattering the glass after penetration by the glass spike.

Figure 13:
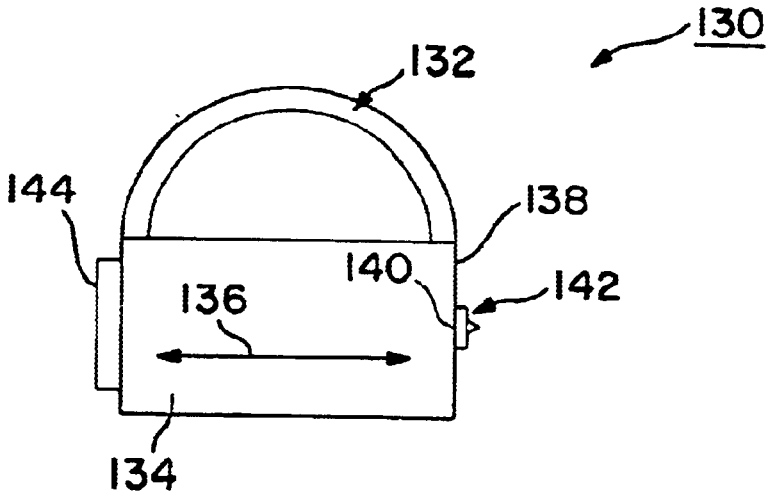
FIG. 13 is an illustration of another emergency flashlight made in accordance with the present invention.
Figure 14:
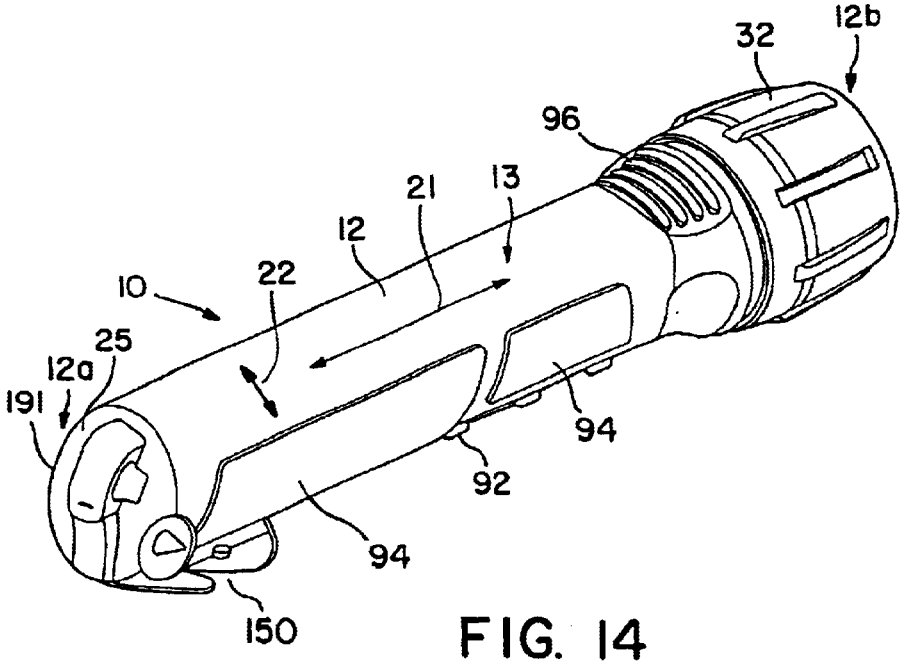
FIG. 14 is a perspective view of an emergency flashlight made in accordance with the present invention.
Figure 15:
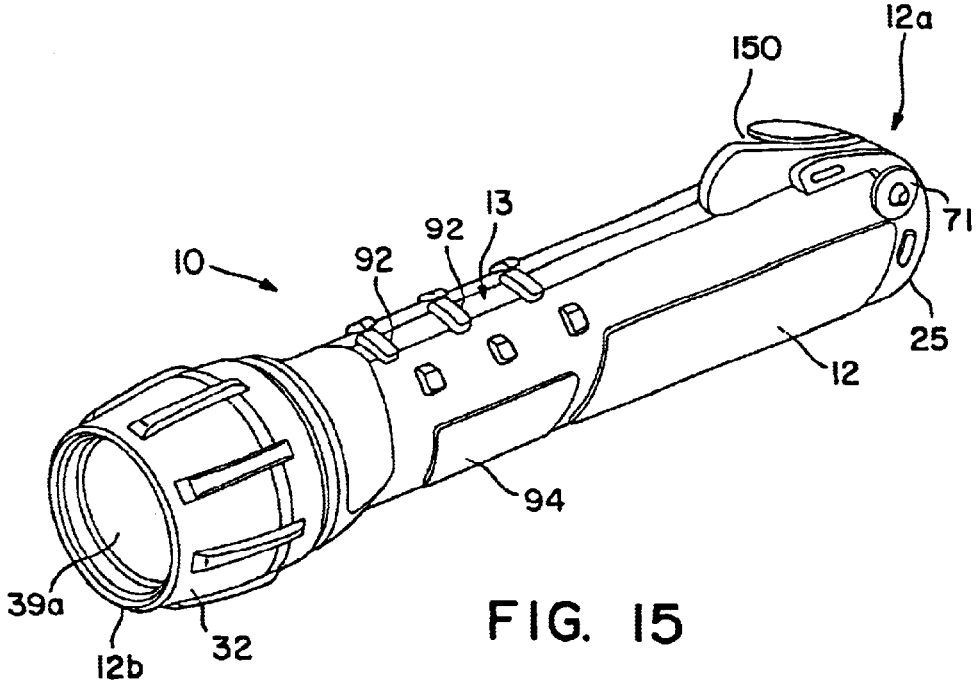
FIG. 15 is another perspective view of the emergency flashlight made in accordance with the present invention.

FIG. 13 shows another embodiment of the present invention, illustrated as emergency flashlight 130. Emergency flashlight 130 has a gripping handle 132 which couples to battery housing 134, and is positioned between a rear wall 138 and a lamp end 144. Battery housing 134 can hold a plurality of smaller batteries, or may be configured to hold a single large battery. Emergency flashlight 130 has a housing that may be rectangularity shaped, but still has a length direction 136. The rear wall 138 of the battery housing 134 has a mounting area 140, which is perpendicular to the length direction 136. A glass breaking spike 142 is mounted to the mounting area 140. The glass breaking spike 142 is like glass breaking spike 71, discussed earlier. The glass-breaking spike 142 may be adhered with an adhesive to the mounting surface 140, or attached via a plug as with emergency flashlight 10. In use, a user propels the flashlight in the length direction so that the glass breaker 142 impacts a pane of glass. In such a manner, the inertia of the battery and flashlight are used to assist in driving the glass breaker 142 into and through the pane of glass.

The glass breaker 71, 120, and 142 are milled from hardened steel in the preferred embodiment. Such a material is used as penetrating tempered glass requires a highly rigid material. However, any other material and manufacturing technique may be used that can achieve a desired shape and strength for glass breaking. For example the glass breaker can be manufactured using alternative techniques such as molding.

The glass breaker 71, 120, and 142 are preferably constructed with integral plug members. The plug members facilitate the removal of the glass breaker from the housing, for example, for repair or replacement. Further, as described above, the integral plugs acts as a safety release for excessive accumulations of pressure within the housing of the emergency flashlight, in the axially mounted embodiment.

One skilled in the art will appreciate that the present invention can be practiced by other than the preferred embodiments which are presented in this description for purposes of illustration and not of limitation, and the present invention is limited only by the claims which follow. It is noted that equivalents for the particular embodiments discussed in this description may practice the invention as well.

What is claimed is:

1. An emergency device with a glass breaking capability, comprising:

a housing having a lamp end, a distal end having a mounting area, and a battery area therebetween; and a glass breaker disposed on the distal end, the glass breaker having an impact surface and being coupled to the mounting area, wherein the impact surface extends away from the distal end of the emergency device;

wherein said glass breaker comprises two impact surfaces, the impact surfaces extending opposite one another and each of the impact surfaces extending in a transverse direction with respect to the distal end of the emergency device.

2. The emergency device according to claim 1, further comprising a battery, the battery being aligned with the axial direction so that as the emergency device is moved in the axial direction with the impact surface leading, inertial force of the battery is transferred to an impact site through the impact surface.

3. The emergency device according to claim 1, further comprising a removable battery carrier in the battery area, the battery carrier for holding a plurality of batteries, the battery carrier supporting each battery individually so that inertial force from one battery does not damage a next battery.

4. The emergency device according to claim 1, further comprising a removable battery carrier in the battery area, the battery carrier for holding a plurality of batteries, the battery carrier supporting two or more of the batteries together.

5. The emergency device according to claim 1, where the glass breaker is mounted on a distal wall of the housing.

6. The emergency device according to claim 1, where the glass breaker has a base for providing increased contact area with the housing.

7. The emergency device according to claim 6, where the base also limits the depth that the impact tip can penetrate an impact site.

8. The emergency device according to claim 1, further comprising a distal wall and a spring for biasing a battery against the distal wall so that when the glass breaker impacts an impact site, battery movement is minimized.

9. A method of making an emergency device, comprising:

providing a housing with a lamp end and a distal end opposite the lamp end, the lamp end in a rearward axial direction from the lamp end, a transverse direction being perpendicular and extending radially outward from the axial direction;

forming a mounting area at the distal end of the housing;

extending a glass breaker from the mounting area; and securing the glass breaker to the mounting area;

wherein said glass breaker comprises two impact surfaces, the impact surfaces extending opposite one another and each of the impact surfaces extending in a transverse direction with respect to the distal end of the housing.

10. The method according to claim 9, further comprising the step of providing a battery, the battery being aligned with the axial direction so that as the emergency device is moved in the axial direction with the impact surface leading, inertial force of the battery is transferred to an impact site through the impact surface.

11. The method according to claim 9, further comprising the step of providing a removable battery carrier in a battery area, the battery carrier for holding a plurality of batteries, the battery carrier supporting each battery individually so that inertial force from one battery does not damage a next battery.

12. The method according to claim 9, further comprising the step of providing a removable battery carrier in a battery area, the battery carrier for holding a plurality of batteries, the battery carrier supporting two or more of the batteries together.

13. The method according to claim 9, where the glass breaker includes a pressure plug that is received in a hole in the mounting area, the pressure plug being ejected from the housing by an excessive pressure from within the housing, thereby releasing housing pressure.

14. The method according to claim 9, where the glass breaker is mounted on a distal wall of the housing.

15. The method according to claim 9, where the glass breaker has a base for providing increased contact area with the housing.

16. The method according to claim 15, where the base also limits the depth that the impact tip can penetrate an impact site.

17. The method according to claim 8, further comprising the step of providing a distal wall and a spring for biasing a battery against the distal wall so that when the glass breaker impacts an impact site, battery movement is minimized.

18. The emergency device according to claim 1, wherein the housing has one or more grip elements selected from the group consisting of projections, facets and ribs.

19. An emergency device comprising:

a housing having a lamp end, a distal end having a mounting area, and a battery area therebetween, the battery area having a first divider located at a first position in the battery area, the first position being between a location for a first battery in the battery area and a location for a second battery in the battery area, the battery area having a second divider located at a second position, the second position being between the location for the second battery and a location for a third battery in the battery area; and a glass breaker disposed on the distal end, the glass breaker having an impact surface and being coupled to the mounting area, wherein the impact surface extends away from the distal end of the emergency device.

20. An emergency device comprising:

a housing having a lamp end and a battery area; and a clip having a cutting blade, wherein said clip is attached to the outside of said housing.

21. The emergency device of claim 1, wherein the glass breaker comprises a tip.

22. The emergency device of claim 1, wherein the glass breaker comprises a spike.

23. The emergency device according to claim 1, wherein the glass breaker is milled from hardened steel.

24. The emergency device of claim 19, wherein the impact surface is a first impact surface, further comprising a second impact surface.

25. The emergency device of claim 24, wherein the first impact surface and the second impact surface each extend in a direction transverse to a longitudinal axis of the emergency device.

26. The emergency device of claim 19, wherein the impact surface extends in an axial direction from the distal end.

27. The emergency device of claim 20, wherein the clip is hinged to the housing.

28. The emergency device of claim 20, wherein the clip includes at least two guide surfaces adjacent the cutting blade.

29. The emergency device of claim 20, wherein the cutting blade is recessed within the clip.

30. The emergency device of claim 27, wherein said clip includes at least two guide surfaces adjacent the cutting blade.

31. The emergency device of claim 20, further comprising a glass breaker comprising an impact surface, wherein said glass breaker is disposed at end extends away from an end of said housing distal from said lamp end.

32. The emergency device of claim 31, wherein said glass breaker extends in a direction transverse to longitudinal axis of said emergency device.

33. The emergency device of claim 27, further comprising a glass breaker comprising and impact surface, wherein said glass breaker is disposed at and extends away from an end of said housing distal from said lamp end.

34. The emergency device of claim 33, wherein said glass breaker extends in a direction transverse to a longitudinal axis of said emergency device.

* * * * *